US006905038B2

(12) United States Patent
Lopez

(10) Patent No.: US 6,905,038 B2
(45) Date of Patent: Jun. 14, 2005

(54) CONTAINER WITH LARGE OPEN END AND OPPOSED CLOSED SMALLER END, AND CONCAVE END CAP WITH DETACHABLE CLOSURE AND INNER THREADED OPENINGS FOR BOTH ENDS OF CONTAINER

(76) Inventor: Salvadore Lopez, Reparto Ramos #16 Bo. Borinquen, Aguadilla, PR (US) 00603

( * ) Notice: Subject to any disclaimer, the term of this patent is extended or adjusted under 35 U.S.C. 154(b) by 10 days.

(21) Appl. No.: 10/651,624

(22) Filed: Aug. 30, 2003

(65) Prior Publication Data

US 2005/0045632 A1 Mar. 3, 2005

(51) Int. Cl.[7] ..... B65D 39/00
(52) U.S. Cl. ..... 215/228; 220/212
(58) Field of Search ..... 215/228, 256, 215/DIG. 7, 376, 330, 331; 220/212, 916

(56) References Cited

U.S. PATENT DOCUMENTS 477,618 A * 6/1892 Becher ..... 43/117
2,086,404 A * 7/1937 Daniels ..... 215/377
2,990,080 A * 6/1961 Harris ..... 215/228
3,402,844 A * 9/1968 Chin ..... 215/393
5,462,187 A * 10/1995 Gregory et al. ..... 215/350
5,829,607 A * 11/1998 Ibrahim ..... 215/44
6,164,473 A * 12/2000 Waldrip ..... 215/378
6,398,050 B1 * 6/2002 Allora ..... 215/228

FOREIGN PATENT DOCUMENTS

DE 3921971 * 6/1991 ..... 215/288

* cited by examiner

*Primary Examiner*—Lien M. Ngo

(57) ABSTRACT

A container with a large open end and a smaller neck, with external threading and extended collars on large open end to mate with internal threads of a large socket on concave base end cap, and secure closure band correspondingly, and threading and extended collar on smaller closed end to mate with internal threads of smaller socket in the concave base end cap and stabilize container in cap correspondingly. The concave end cap providing resistance to gaseous contents provides a stable end surface, thus, allowing the container to be configured into a stemmed recipient without losing balance.

6 Claims, 2 Drawing Sheets

FIG.1
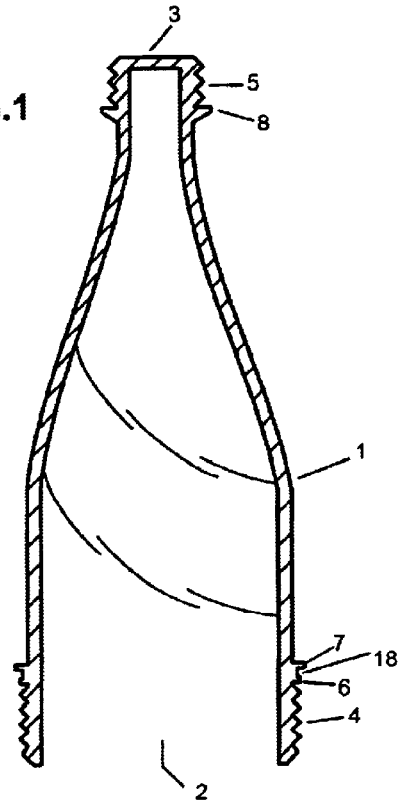
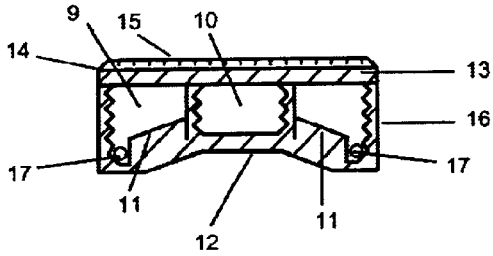
FIG.2A
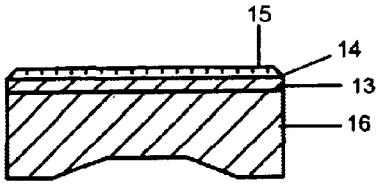
FIG.2B
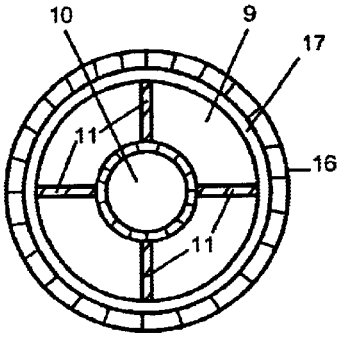
FIG.2C
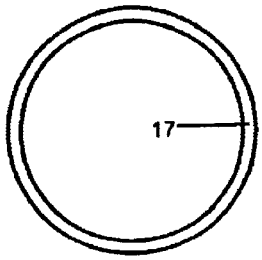
FIG.2D

CONTAINER WITH LARGE OPEN END AND OPPOSED CLOSED SMALLER END, AND CONCAVE END CAP WITH DETACHABLE CLOSURE AND INNER THREADED OPENINGS FOR BOTH ENDS OF CONTAINER

CROSS-REFERENCE TO RELATED APPLICATIONS

BACKGROUND OF THE INVENTION

1. Field of the Invention

The present invention relates generally to closable and seal able containers for solids, gases and or liquids, and more particularly to containers with a wide-open mouth for easy dispensing or access to its contents. Even more particularly, the present invention relates to a recipient, which allows additives to its contents.

2. Description of Related Art

Containers are used in the United States and abroad and bottle shape containers have been proven to be popular and widely accepted. Wide mouth recipients have also been proven to be a popular and widely accepted means of handling the contents of said bottle shape containers, as well as other contents dispensed by different type containers. Combinations of both containers and recipients with openings on both ends have been conceived as early as 1892 and perhaps even earlier. However their features have not proven to be production or cost efficient.

Accordingly a need a container with a large open end and a smaller closed end that also proves to be cost efficient and simple to produce will be seen by marketers and accepted by the general public. Further more a container/recipient, which can protect the consumer of various contagious illnesses, will prove to be desirable and beneficial. A description of the related art of which the present inventor is aware, and its differences and distinctions from the present invention, is provided below.

U.S. Pat. No. 477,618 issued on Jun. 21, 1892 to Carl Becher, titled "Fluid-Receptacle for fly traps," describes a receptacle having an opening at both ends thereof, and two separate caps for each opening thereof, with the large open end of the receptacle having innermost threading to secure the large caps outermost threading and the smaller open end of the receptacle having outermost threading to secure the smaller caps innermost threading. The larger cap having an opening that fits to the smaller end, therefore making it one of the earlier inventions of this type. However the Becher receptacle has inner threading at its larger opening, and openings on both ends, having two separate caps for each end. The present invention is clearly different from Bechers fluid-receptacle for fly traps having outer threading on both ends with larger end open and smaller end closed and having one cap only.

U.S. Pat. No. 2,086,404 issued on Jul. 6, 1937 to Gervase P. Daniels, titled "Combination container and goblet for liquids," describes a liquid container having both ends open, with the smaller end having an extended collar and end caps for each end correspondingly. The smaller cap having a bayonet joint that locks into a bayonet slot in a center socket of the larger cap. Both ends configured for conventional crimped metal caps. The Daniels container has no threading on either end and needs two separate size caps for both ends of the containers. The present invention has one cap and one large opening with closed smaller end and threading on both ends.

U.S. Pat No. 2,990,080 issued on Jun. 27, 1961 to Melvin A Harris, titled "Inverted bottle support," describes a device for supporting a conventional bottle, either upright or inverted. The device comprises a relatively wide circular plate with a central socket for receiving a specially configured stopper end. The Harris invention is configured to support a conventional bottle either upright or inverted and no container with a large open end is disclosed.

U.S. Pat No. 5,822,607 issued on Nov. 3, 1998 to Moheb M, Ibrahim, titled "Double ended bottle," describes a container providing identical size openings at each end. Identical caps are provided at each end, with the caps being substantially the same diameter as the bottles openings and as one Another. Thus, it is Possible to secure one cap on either end, the Ibrahim bottle has two openings and does not configure into a wide opening recipient as is possible with the present single opening wide mouthed container invention.

U.S. Pat No. 6,164,473 issued on Dec. 26, 2000 to Leland R. Waldrip, titled "Beverage container/drinking vessel," describes a container providing essentially the same function as the devices of the Daniels '404 U.S. Patent discussed above and the Alloras '050 U.S. Patent discussed below, and the present Invention described herein, i.e., A configurable container for storing and distributing liquids and/or solids and for use as an open mouthed vessel in another configuration. The Waldrip container describes several embodiments, in one embodiment similar to Daniels and Alloras devices shows a container with two separate caps and a method of attaching both caps together configuring into a drinking vessel. In another configuration much like the present invention shows one large open end and a smaller closed end, and one end cap with two openings, however Waldrips container does not show or describe any means to prevent gaseous contents from deforming, when expanding, the base lids outermost end, whereas, one of the objects of the present inventions concave cap is, to provide the means to resist the deforming of its outer end produced by said expanding gases, such as carbonated beverages, thus, providing a stabile base/stand in both configurations of the container. Furthermore the present invention provides an extended collar with the means to further stabilize the container to the cap when configured as a stemmed recipient and also functions as a non-slip grip when configured as a container. Further yet Waldrip describes a locking device with a pull tab, whereas, the present invention provides a detachable closure band which remains on the container by means of two extended collars below the treading of large open end, thus, allowing all of its components to be kept or recycled, yet none disposed of. Therefore there is no motivation for Waldrip, mentioned or provided in any of his embodiments, either singly or in combination that describes the means above-mentioned of the present invention.

U.S. Pat. No. 6,398,050 issued on Jun. 4, 2002 to Vincent M. Allora, title "Liquld container with opposed openings and an end cap for each opening, the end caps engageable for stabilizing the container on a smaller end thereof," describes a container providing essentially the same function as the device of the Daniels '404 and Waldrips '473 U.S. Patents discussed above, i.e., a configurable container with two open ends and two separate caps. The Allora container has more similitude with the above-mentioned containers than with the present invention, as thus, having two openings and two separate caps, whereas the present has one opening and one cap, with both ends threaded and an extended collar for stabilizing the container thereof.

German Patent Publication No. 74,261 published on Apr. 5, 1894, illustrates a bottle and cup assembly. The bottle appears to have externally threaded neck, with the cup having an internally threaded base for securing to the neck of the bottle. The cup thus provides a closure for the bottle, and when removed, provides a container from which a liquid may be consumed. While the cup includes a relatively wide base, and might be used to support the bottle in an inverted position, there is no motivation for such a configuration since there is no opening in the base of the bottle.

German Patent Publication No. 3,921,971 published on Jan. 17, 1991 "describes a bottle for inverted suspension within a refrigerator. The bottle has a relatively larger base and small neck, with the neck disposed downwardly for dispensing the liquid there through, rather than being closed, as in the present container. The larger cap is normally disposed a top the wider end of the bottle, but may be removed there from and placed beneath the spout of the smaller lower cap to support the bottle thereon. In this configuration, the upper end of the bottle is open for filling. This device differs from the present invention in that the smaller dispensing cap has a passage there through and is adapted for dispensing liquids there from in an inverted position, whereas the present invention is closed on the smaller end and has no separate smaller cap, therefore liquid cannot pass there through. Also, the spout of the smaller cap of the '971 German bottle merely nests in a socket in the larger cap when the larger cap is removed and placed there under, rather than screwing on the large caps smaller opening, as in the present single opening container. This is a crucial point, as when the bottle in this configuration is lifted from the underlying surface, the larger cap will remain behind, as it is not positively attached to the smaller end. The present container/recipient invention provides positive attachment means for the cap to either end of the container.

It is clear to the inventor that none of the above mentioned inventions and patents, either singly or in combination, is seen to describe the instant invention as claimed.

BRIEF SUMMARY OF THE INVENTION

The present invention comprises a container/recipient having opposite ends of unequal diameter, with the container ends being externally threaded to prevent splashing of fluids, when drinking from the recipient, as happens with internally threaded recipients; the mating cap/stand having two internally threaded open sockets with its opposite side having a concave closed end, comprising; a first large diameter socket with a second central smaller diameter socket and internal threading adapted for positively screwing on the containers ends correspondingly to their size with a detachable closure band having a folding crimped edge and ribbed arches in caps larger diameter socket thereby, providing better resistance of the containers contents; a ring of impermeable material inserted between the ribbed arches and the larger sockets threaded wall, to prevent leakage. The smaller end of the container having an extended collar below the threading prevents slipping of the container when handled and also provides better stability when the base cap is engaged to the smaller end of the container. The larger end of the container having two extended collars of different diameters, below the threading, allow for the base caps closure band to remain on the container when the end cap is removed from the base and the closure band detaches from it. This configuration allows for the container to convert into a opened mouthed stemmed recipient allowing the consumer to drink thereof, as when drinking from a stemmed glass or consume its contents with the use of a utensil, furthermore the recipient makes a novel flower pot.

Accordingly, it is an object of the present invention to provide a large opened end container for transporting, storing, displaying and dispensing or consuming its contents.

Another object is to provide a cap with threaded internal fittings for both ends of the container for use as a stand or as a closure cap.

A third object is to provide a closure band, which detaches from its end cap and remains on the container to provide tamper proof quality for its contents.

It is a further object of the present invention to provide a container where none of its components are discarded, but rather saved or recycled.

Yet another object of the invention is to provide an extended collar, which stabilizes the container when configured as a stemmed recipient, and provides a non-slip grip when handled or transported.

Another object is to provide a concave cap, based on the principals of arches and domes, to resist pressure of gaseous contents and maintain a surface that can serve as a stand.

Yet another object is to provide an impermeable seal as to prevent leakage of liquid contents.

It is a further object of the present invention to provide an area covered by the end cap which remains sterilized until exposed by the consumer, thus, preventing exposure of its contents to contagious illnesses.

And yet a final object of the present invention is to allow additives to its original contents.

In conclusion the present container provides means of transporting, handling, storing or displaying its contents and of consuming or adding to its contents, such as ice, liquor, powder supplements and others. The cap/stand in the present invention when used as a stemmed recipient serves as a coaster to avoid spillage of its contents coming in contact with the surface where it is placed. It is versatile, novel, reusable and decorative. The present invention can be formed in molds, blow molded or even sculpted. It can be made in different geometrical shapes, different sizes and materials. It can be used for beverages, frozen deserts, soups, candies and also dirt for a convenient ready to use flowerpot, but not limited to the above mentioned. A content separator such as foil, plastic or other may be placed over the large open end separating viscous contents from the sockets of the base end cap, thus keeping the contents from entering the orifice of the large and smaller sockets.

BRIEF DESCRIPTION OF THE SEVERAL VIEWS OF THE DRAWING

FIG. 1 is a view of the container with large open end and opposed closed end, showing externally threaded ends and extended collars.

FIG. 2A is a partial view of the concave base cap, showing larger and smaller threaded sockets, further showing the detachable closure band with folding crimped edge.

FIG. 2B is a partial view of the concave base cap.

FIG. 2C is an elevated partial view of the concave base cap showing the ribbed arches and further showing the ring of impermeable material.

FIG. 2D is a partial view showing the ring of impermeable material.

DETAILED DESCRIPTION OF THE INVENTION

Figure 3:
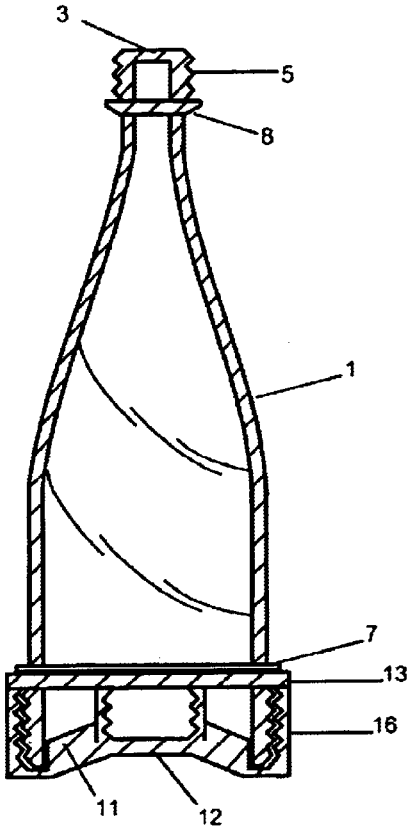
FIG. 3 is a full view of the container with the concave base cap secured to the large threaded end of the container.

The present invention comprises a container having an open large base end and a closed opposite end thereof. The base cap may be engaged on either end. This permits the end cap to serve as a base for the assembly or a stand for the stemmed recipient, for dispensing or displaying its contents there from.

FIG. 1 illustrates a view of the present container assembly 1, comprising; a large open end 2, with opposed smaller closed end 3, the container having a relatively large diameter externally threaded end 4, with an opposite smaller diameter externally threaded end 5. The larger end includes a smaller extended collar 7, with a space 18, separating small extended collar 6, from larger extended collar 7, the smaller end of the container includes an extended collar 8, below the threading 5.

FIG. 2A provides a partial view of the detachable base cap 16, comprising a large threaded socket 9, and a smaller threaded socket 10, with ribbed arches 11, on opposite side of concave closed end 12, of cap. A detachable closure band 13, with a folding 14, crimped edge 15. Further showing the impermeable ring 17.

FIG. 2B is an outer view of the base cap 16, showing the closure band 13, and the crimped edge 15, which secures the closure band 13, to the containers space 18 in FIG. 1 by folding 14, inwardly to closure band 13.

FIG. 2C is a elevation view of the end base cap 16, showing the large socket 9, and the smaller socket 10, further showing the ribbed arches 11, extending from the outer wall of the small socket 10, and ending abruptly before reaching the inner threads of the larger socket 9, further yet showing the impermeable ring 17, compressed between the ribbed arches 11, and the inner threaded wall of the large socket 9.

FIG. 2D shows a view of a ring made of impermeable material 17, used to prevent leakage of the containers contents.

FIG. 3 is a view of the container 1 configured to transport its contents. With its base end cap 16, attached and its closure band 13, secured between the small-extended collar 6 in FIG. 4 and FIG. 5, and the larger extended collar 7.

Figure 4:
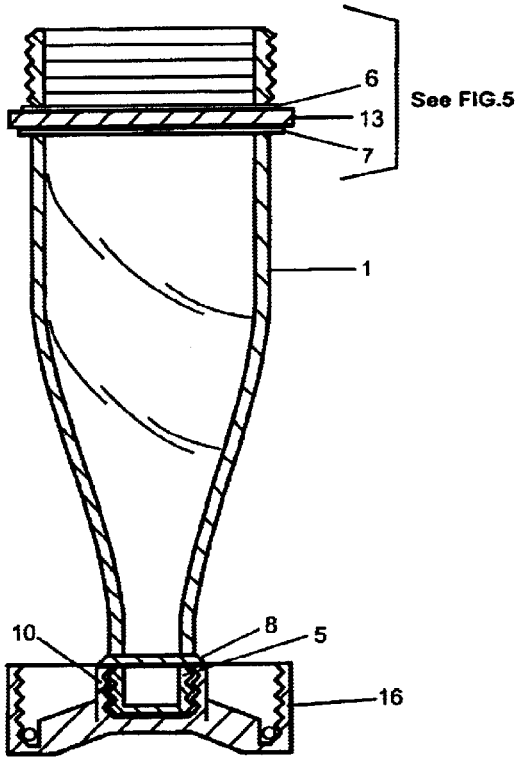
FIG. 4 is a view of the container configured into a stemmed recipient with the concave end cap engaged on the containers smaller closed threaded end, further showing the closure band remained on the container after detachment from the concave end cap.

FIG. 4 is a full view of the container 1, configured as a stemmed recipient, showing the base end cap 16, attached to smaller diameter threaded end 5, with extended collar 8, resting atop of the base caps 16, smaller socket 10, providing additional stability. Further showing closure band 13, remaining between small-extended collar 6, and larger extended collar 7.

Figure 5:
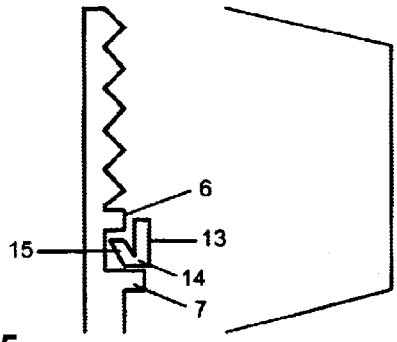
FIG. 5 provides an exploded section view of FIG. 4, showing the folded crimped edge securing the closure band between the extended collars below the threading of the containers larger open end.

FIG. 5 is an exploded section view of FIG. 4 the folded 14, crimped edge 15, securing the closure band 13, between small-extended collar 6, and larger extended collar 7, after separation from the base end cap 16, in FIG. 4, thus allowing all of the components to be kept or recycled and not disposed of.

In conclusion, the present invention provides the means for enclosing its contents, liquids, solids and/or gaseous accordingly with the materials used to make said container, for transport, display or storage. Further provides the means for dispensing, displaying or adding to its contents when configured as a stemmed recipient.

The present container can be made in different sizes, colors, materials and ornamental designs. It may address a health issue that concerns millions of Americans and people worldwide, who worry of contact with contagious or transmittable illnesses by means of unsanitized drinking vessels at restaurants, bars, pubs, etc. . . It provides for a wide mouth vessel that may keep its contents sealed until dispensed by the consumer. At the discretion of each individual manufacturer, a content separator such as foil, plastic wrap or a molded piece can be attached to the recipients large open end, to maintain its contents freshness and prevent viscous contents from entering the sockets of the base end cap, without departing from the scope of the invention.

It is apparent from the foregoing discussion that the present invention has taken into consideration problems and issues that previous inventions of similar appearance have not, such as production and cost efficiency, whereas the modifications to convert present machinery to produce said container would be minor. Moreover, the deforming of the base end cap caused by expansion of its contents, stability of the container in the base end cap and stability of the container on the surface placed in both configurations, the means to prevent leakage of its contents. Further defined in the following claims hereon appended.

I claim:

1. A container with a large open end and a smaller closed end comprising:

the container having a large diameter first end and a small diameter second end, opposite said first end;

said first end including a large diameter opening therein, and said second end closed;

said first end having external threads with a first small extended collar and a second larger extended collar below threading with a space between both said collars, and said second end having external threads with a third extended collar below threading;

a base end cap removably, connected to said, first end of container, having a first large internally threaded socket and a second smaller internally threaded socket therein, and a concave closed end opposite said sockets;

said base end cap having internally ribbed arches extending from, second small socket outermost wall and ending abruptly before reaching the first large socket threaded wall;

said base end cap having a ring of impermeable material inserted between the abrupt endings of the arched ribs and said large socket threaded wall;

said base end cap having a detachable closure band with a inner folding crimped edge; and means for connecting, said base second smaller socket to second small diameter end of container thus, configuring the container into a stemmed recipient.

2. The container according to claim 1, wherein, the third extended collar provides the means to stabilize the container, when said second externally threaded closed end is engaged with, second smaller threaded socket in base end cap.

3. The container according to claim 1, wherein, the third extended collar provides the means for precluding inadvertent slipping of the container when handled.

4. A container according to claim 1, wherein, the base end cap by means of said ribbed arches and concave opposite end resist the pressure exerted by gaseous contests, thus providing stability in both configurations.

5. A container according to claim 1, wherein the detachable closure band remains on said container after the base end cap is removed by means of said first and second extended collars and closure bands folded crimped edge.

6. The container according to claim 1, wherein, said impermeable ring provides the means to prevent leakage of the containers contents.

* * * * *